US005123761A

United States Patent [19]

Rosenthal

[11] Patent Number: 5,123,761

[45] Date of Patent: Jun. 23, 1992

[54] OFFICE MACHINE

[75] Inventor: Manfred Rosenthal, Kirchen-Freusburg, Fed. Rep. of Germany

[73] Assignee: U.S. Philips Corporation, New York, N.Y.

[21] Appl. No.: 317,376

[22] Filed: Mar. 1, 1989

[30] Foreign Application Priority Data

Mar. 10, 1988 [DE] Fed. Rep. of Germany ..... 3807808

[51] Int. Cl.[5] ..... B41J 15/04

[52] U.S. Cl. ..... 400/605; 400/625; 400/616.2; 271/303

[58] Field of Search ..... 400/616.2, 616, 605, 400/625; 271/303

[56] References Cited

U.S. PATENT DOCUMENTS

| | | | |
|---|---|---|---|
| 4,360,279 | 11/1982 | Sugiura | 400/605 |
| 4,688,957 | 8/1987 | Preuignano | 400/625 |
| 4,743,132 | 5/1988 | Chikata et al. | 400/625 |
| 4,806,036 | 2/1989 | Ward et al. | 400/605 |

FOREIGN PATENT DOCUMENTS

| | | | |
|---|---|---|---|
| 3208111 | 9/1983 | Fed. Rep. of Germany . | |
| 0185670 | 10/1984 | Japan | 400/605 |
| 0180867 | 9/1985 | Japan | 400/625 |
| 0191951 | 9/1985 | Japan | 400/625 |
| 0198274 | 10/1985 | Japan | 400/625 |
| 0016976 | 1/1987 | Japan | 271/303 |
| 0097871 | 5/1987 | Japan | 400/616 |
| 0134280 | 6/1987 | Japan | 400/605 |
| 2197737 | 5/1988 | United Kingdom | 400/605 |

*Primary Examiner*—David A. Wiecking
*Assistant Examiner*—John S. Hilten
*Attorney, Agent, or Firm*—William Squire

[57] ABSTRACT

In an office machine, for example a printer, with an endless paper transport mode via a tractor and with an individual paper transport mode via driving rollers, one mode of operation is changed to the other in a simple way. A two-armed rotary lever is rotatably mounted relative to the housing and is positively coupled selectively to a paper switch for deflecting the paper path in accordance with the selected mode and selectively to the drive of the tractor, in such a way that, during the connection and disconnection of the tractor drive for respective endless paper and transport and idle modes, a change-over of the path switch takes place simultaneously.

17 Claims, 2 Drawing Sheets

OFFICE MACHINE

BACKGROUND OF THE INVENTION

1. Field of the Invention

The invention relates to an office machine with a printing unit, an endless paper transport via a tractor and with an individual paper transport via driving rollers.

2. Description of the Prior Art

Of interest are commonly owned copending applications Ser. No. 487,674 filed Mar. 1, 1990 entitled "Device for Adjustment of a Printer," Ser. No. 487,677 filed Mar. 1, 1990 entitled "A Device Comprising a Printing Mechanism," and Ser. No. 317,378 entitled "Office Machine" all in the name of M. Rosenthal and Ser. No. 321,620 filed Mar. 9, 1990 in the name of Durr et al.

An office machine of this type, designed as a printing machine, became known, for example, from German patent specification 3,208,111. In this known version, the individual paper transport takes place in a base part with a paper feed from the front and a paper removal at the rear. The printing unit and the endless-form transporter are connected pivotably to the base part, and the endless-form transporter is additionally connected to the printing unit so that it can be swung up. The paper path for the endless forms runs from an inlet on the lower front side, via a tractor in the endless-form transporter, to an outlet on the upper front side of the endless-form transporter. The two paper paths are therefore completely separate from one another.

SUMMARY OF THE INVENTION

The object on which the invention is based is to improve an office machine of the type mentioned in the introduction, in such a way that it is possible to change from one mode of operation to the other, without special conversion work being necessary for obtaining the different paper paths. This object is achieved because a switch rotatable in the housing is provided for deflecting the two paper paths forming a common path zone behind the printing unit, because the switch can be coupled to the tractor drive via a two-armed rotary lever, and because, whenever the tractor drive is connected or disconnected as a result of a rotational movement, a sumultaneous change-over of the switch takes place. Such a positive coupling between the switch, on the one hand, and the tractor on the other hand ensures that, when the tractor drive is disconnected, an individual paper transport via driving rollers becomes possible and the individual papers are deposited in a delivery compartment as a result of a corresponding position of the switch. In contrast, when the tractor drive is connected, the endless paper transport is set in motion, and at the same time, by means of the switch which is then adjusted, the endless papers are conveyed not into the delivery compartment, but out of the machine through a special slit on the side of the switch located opposite the delivery compartment.

A reliable design is obtained if, in an embodiment of the invention, the rotary lever has two lockable positions, and if in a first lever position the tractor is driven for endless paper transport and the switch is set at endless paper delivery, and if in a second lever position the tractor drive is disconnected, the pairs of rollers are set for individual paper transport, and the switch is adjusted to individual sheet delivery. A connection between the switch and the rotary lever which can easily be made is obtained advantageously because one lever arm of the rotary lever is operatively connected in an articulated manner to the free end of a shackle which is coupled firmly to a rotary axle of the switch. Because the shackle engages by means of a peg projecting at right angles into a fork-shaped recess formed at the end of the lever arm, an especially robust design not liable to faults is obtained.

The actuation of the tractor drive preferably takes place because the other lever arm of the rotary lever carries a driving roller which is driven by a main drive of the office machine and which, during the rotation of the rotary lever, can be brought into or out of engagement with a driving wheel of the tractor. This type of connection and disconnection of the tractor drive is of simple design and not liable to faults. The rotary lever can be actuated in various ways. In a preferred embodiment, the two-armed rotary lever is adjustable via a motor-driven eccentric which acts on one of the two lever arms. This preferably takes place because one of the lever arms has a clearance, into which the eccentric penetrates with a fit. Depending on the type of machine, manual actuation can also be advantageous, the two-armed rotary lever being provided with an additional hand lever. Finally, the rotary lever can be adjusted as a result of a horizontal movement of a printer slide.

BRIEF DESCRIPTION OF THE DRAWING

An exemplary embodiment of the invention is illustrated diagrammatically in FIGS. 1 and 2 of the drawing and explained together with further advantages in the description of the drawing. The two Figures each show a side view of the parts of a printer which are essential to the invention.

DESCRIPTION OF THE PREFERRED EMBODIMENT

Figure 1:
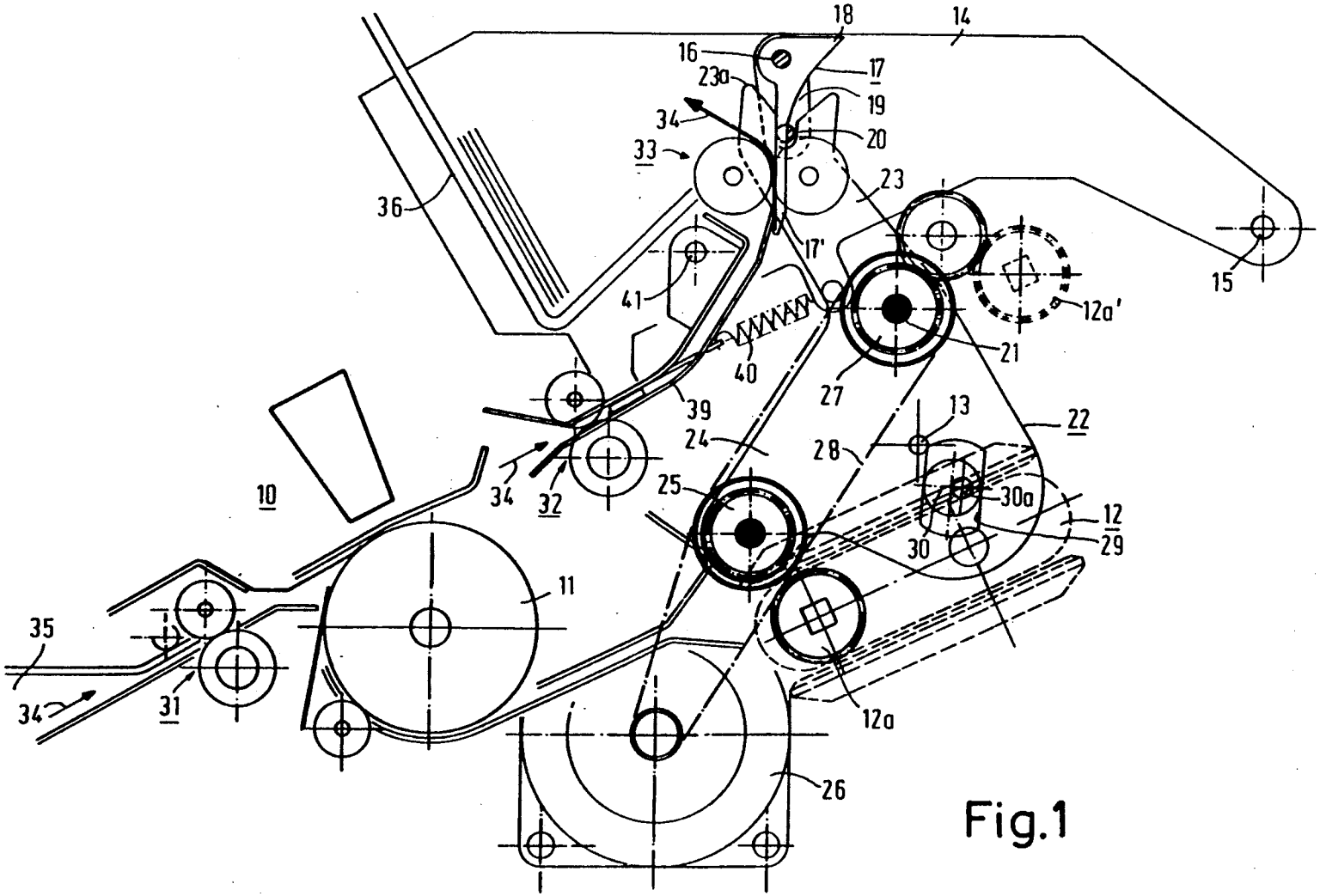
FIG. 1 shows the printer in the "individual paper transport" mode of operation and FIG. 2 shows the printer in the "endless paper transport" mode of operation.

The printer, of which the housing and housing walls are not shown, possesses, as a central component, a printing unit 10 with a printing roller 11 mounted in the side walls of the housing. 12 designates a tractor for the transport of endless paper, which is mounted rotatably in the housing walls via pin 13 and which can assume two lockable end positions. 14 denotes a pivoting part which is rotatable at the center of rotation 15 of the housing walls and which, when swung up, makes it possible or easier to gain access to the tractor 12. The pivoting part 14 carries a switch 17 which is rotatable at the point 16 and which is provided with a tear-off edge 18 and has a shackle 19 arranged fixedly in terms of relative rotation and possessing a peg 20.

Furthermore, mounted rotatably in the side walls of the housing at a center of rotation 21 is a two-armed rotary lever 22 which has a first lever arm 23 and a second lever arm 24. The first lever arm 23 is connected to the peg 20 of the shackle 19 via a fork-shaped clearance. The second lever arm 24 carries a driving roller 25 which is driven by a main drive 26, via a toothed belt 28, together with a further driving roller 27 mounted at the center of rotation 21. The rotary lever 22 contains an opening 29, into which an eccentric 30 penetrates. Pairs of rollers respectively having driving rollers and pressure rollers are designated by 31, 32 and 33.

In FIG. 1, 34 denotes the paper path for individual papers which are fed in a channel 35 and which are deposited in delivery compartment 36. Rotation of the eccentric 30 in FIG. 1 to the position shown caused the rotary lever 22 to be pivoted in the clockwise direction about the center of rotation 21, so that the driving roller 25 is disengaged from the driving wheel 12*a* of the tractor. The tractor 12 therefore cannot convey any endless paper in this position. As a result of the rotational movement of the rotary lever 22 to the position shown, the switch 17 is simultaneously moved counter clockwise about the center of rotation 16 via the fork-shaped end 23*a* of the lever arm 23, so that the switch guide 17′ is to the right in the drawing and the individual papers go past the switch on the left of the guide 17′ and into the compartment 36.

Figure 2:
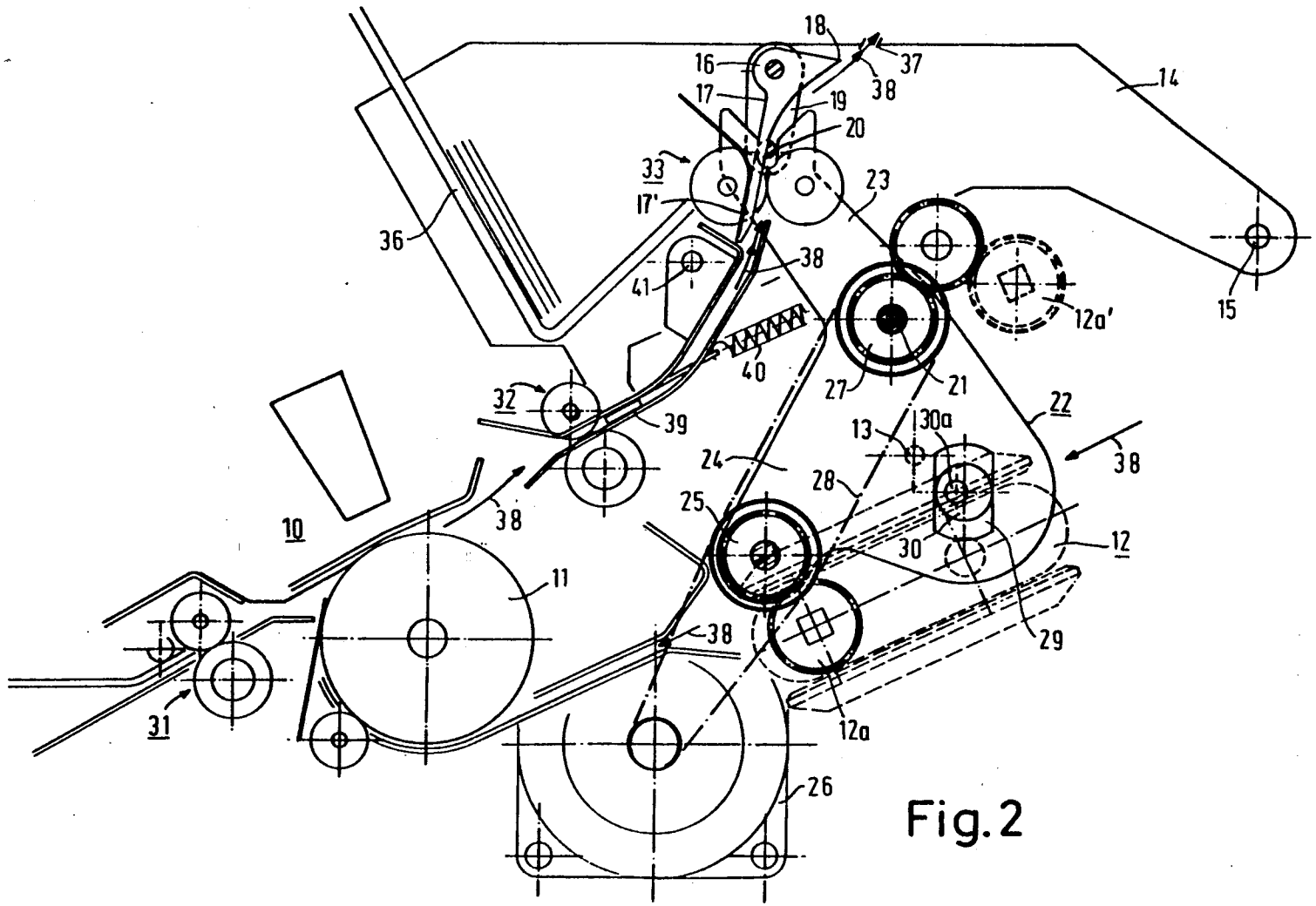

To change over from the individual paper transport mode shown in FIG. 1 to the endless paper transport mode, the eccentric 30 is rotated through 180° about its center of rotation 30*a* and assumes the position shown in FIG. 2. The rotary lever 22 is thereby moved in the counter clockwise direction and brings the driving roller 25 into engagement with the driving roller 12*a* of the tractor 12. At the same time, the switch 17 guide 17′ is moved to the left by means of the peg 20, so that now the path for endless paper transport leads past the switch 17 guide 17′ on the right and leaves the housing through a slit 37. In FIG. 2, 38 denotes the paper path for the endless paper in the operating position for endless paper transport.

39 designates guide plates of paper unit which form a common paper path for the individual papers and the endless papers after they have passed through the printing unit 10. The guide plates 39 are mounted rotatably on the pivoting part 14, via a center of rotation 41, counter to the force of a spring 40. A broken line designated by 12*a*, FIG. 2, in broken line, represents the driving roller of the tractor 12 when the latter, after rotation about the point 13, is engaged in its second swung-up position.

What is claimed is:

1. Office machine with printing unit comprising:
   - an endless paper transport tractor having an endless transport mode and an idle mode;
   - an individual paper transport including at least one drive roller for driving said individual paper,
   - a mechanical paper path switch rotatably secured for receiving and directing individual paper in a first path direction for paper storage in a first switch state and in a second path direction for endless paper delivery in a second switch state; and
   - lever means for selectively placing said tractor in said endless transport and idle modes and for simultaneously placing said switch respectively in said second and first switch states in response to said selectively placing.

2. Office machine of claim 1 wherein said lever means includes a rotary lever such that in one rotary position of the lever the tractor is in one mode and the switch is in the corresponding respective state and when in the other rotary position of the lever, the tractor is in the other mode and the switch is in the other state.

3. Office machine according to claim 1, characterised in that said switch is rotably secured to a rotary axle, said lever means further includes a two-armed rotary lever and a shackle having a free end and which is secured to said axle, one lever arm of the rotary lever being operatively connected in an articulated manner to the free end of the shackle.

4. Office machine according to claim 1, characterised in that said lever means includes a two-armed lever, a lever arm of the lever carries a driving roller which, during the rotation of the rotary lever is selectively engaged with the tractor for placing the tractor in said endless transport and idle modes.

5. Office machine according to claim 1, characterised in that the lever means includes a two-armed rotary lever adjustable via an eccentric which acts on one of the lever arms.

6. Office machine according to claim 1, characterised in that the lever means includes a two-armed rotary lever, said rotary lever having two positions, in that in a first lever position the tractor is driven in the endless paper transport mode and the switch is set to said endless paper delivery state, and in that in a second lever position the tractor is in the idle mode, the at least one roller is set for individual paper transport, and the switch is adjusted to individual sheet delivery in the first state.

7. Office machine according to claim 6, characterised in that the switch includes a projection serving as a tear-off edge.

8. Office machine according to claim 6, characterised in that said switch is rotably secured to a rotary axle, said lever means further includes a shackle having a free end and which is secured to said axle, one lever arm of the rotary lever being operatively connected in an articulated manner to the free end of the shackle.

9. Office machine according to claim 8, characterised in that one arm of the rotary lever has a forked shaped recess at its end, a peg being secured to the shackle, the shackle being engaged by means of the peg projecting at right angles relative to the one arm into the fork-shaped recess formed at the end of the one lever arm.

10. Office machine according to claim 6, characterised in that a lever arm of the lever carries a driving roller which, during the rotation of the rotary lever, can be brought into or out of engagement with a driving wheel is selectively engaged with the tractor for placing the tractor in said endless transport and idle modes.

11. Office machine according to claim 3, characterised in that the switch includes a projection serving as a tear-off edge.

12. Office machine according to one of claims 6 to 10, characterised in that the two-armed rotary lever is adjustable via an eccentric which acts on one of the lever arms.

13. Office machine according to claim 12, characterised in that the latter one lever arm has an opening into which the eccentric penetrates.

14. Office machine according to one of claims 6 to 7 and 1, characterised in that the switch is provided with a projection serving as a tear-off edge.

15. Office machine according to claim 14, characterised in that, in the region located opposite the tear-off edge of the switch, the housing of the office machine includes a delivery compartment for individual sheets.

16. Office machine according to claim 14, characterised in that, in the region of the tear-off edge, the housing of the office machine is provided with an outlet slit for endless paper.

17. Office machine according to claim 16, characterised in that, in the region located opposite the tear-off edge of the switch, the housing of the office machine includes a delivery compartment for individual sheets.

* * * * *